United States Patent [19]

Tucker et al.

[11] Patent Number: 4,606,279

[45] Date of Patent: Aug. 19, 1986

[54] TABLE LEAF SLIDE SUPPORT

[75] Inventors: Herbert J. Tucker, Huntingdon Valley; Frederick A. Tucker, Glenside, both of Pa.

[73] Assignee: Tucker Industries, Inc., Bensalem, Pa.

[21] Appl. No.: 511,547

[22] Filed: Jul. 7, 1983

[51] Int. Cl.[4] ..... A47B 1/04; A47B 1/10

[52] U.S. Cl. ..... 108/78; 108/77

[58] Field of Search ..... 108/65, 73, 77, 78; 248/298, 429; 308/3.6, 3.8; 312/334

[56] References Cited

U.S. PATENT DOCUMENTS

| | | | |
|---|---|---|---|
| 2,470,258 | 5/1949 | Mustafa | 277/429 X |
| 2,731,317 | 1/1956 | Duncan | 108/78 |
| 3,336,881 | 8/1967 | Aiken, Sr. | 108/77 |
| 4,181,383 | 1/1980 | Naef | 312/334 |
| 4,301,744 | 11/1981 | Walter | 108/78 X |

FOREIGN PATENT DOCUMENTS

| | | | |
|---|---|---|---|
| 581417 | 8/1959 | Canada | 108/78 |

*Primary Examiner*—William E. Lyddane
*Assistant Examiner*—Peter R. Brown
*Attorney, Agent, or Firm*—Walter B. Udell

[57] ABSTRACT

A two piece table leaf slide support consisting of a U-shaped metal channel member and a metal support bracket slidably supporting the channel member, the elongated U-shaped channel member having a vertical base wall, and a top flange and a bottom flange extending longitudinally orthogonally of the base wall, one end of the channel being curved with the top and bottom flanges remaining substantially in their respective planes, and a pair of lengthwise spaced apart lancings through the channel member vertical base wall effective to prevent the channel member from jamming or shifting endwise out of the support bracket. The support bracket has a generally rectangular elongated bottom wall and a pair of parallel side walls extending upward from the long edges of the bottom wall and turning outward in plane in opposite directions at the upper edges of the side walls as a pair of top flanges, the top flanges including screw holes by which the bracket may be secured to the underside of a table, and a lancing through one of the sidewalls of the support bracket which extends inward into closely overlying relationship to the bottom flange of the U-shaped channel and is effective to retain the channel member in the bracket below the level of the top flanges.

4 Claims, 5 Drawing Figures

FIG. 1
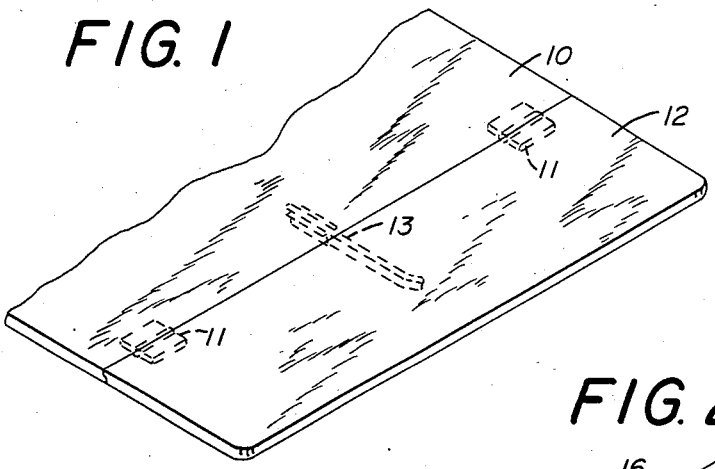
FIG. 2
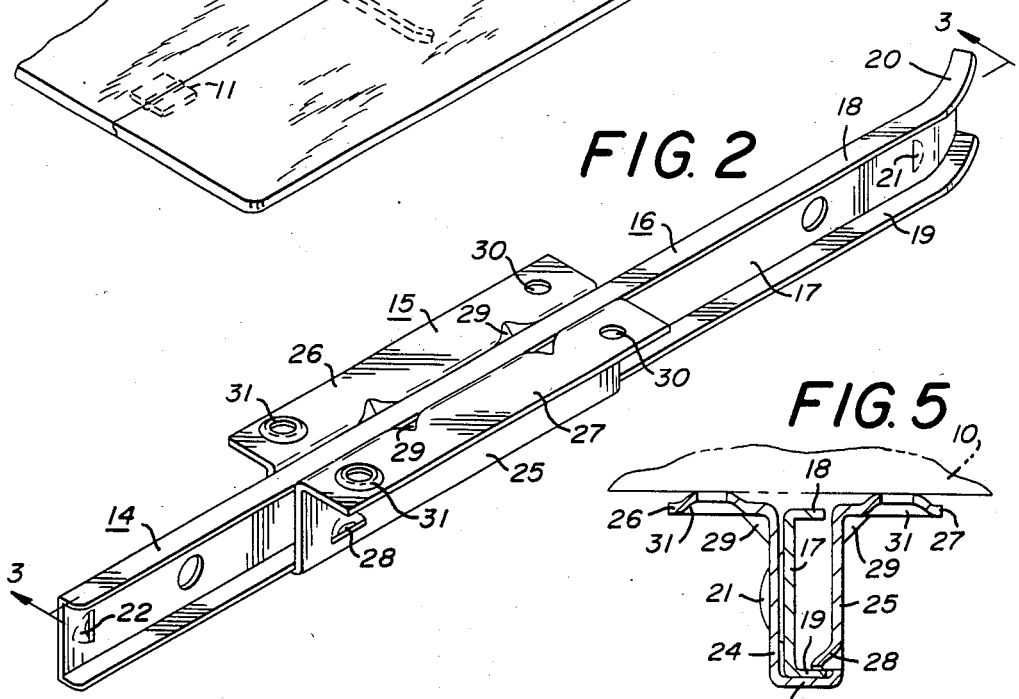
FIG. 5
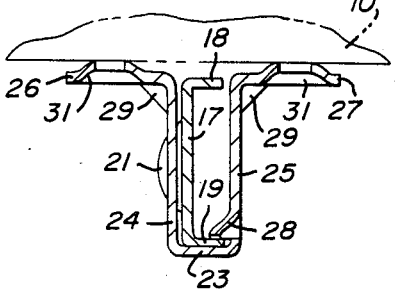
FIG. 3
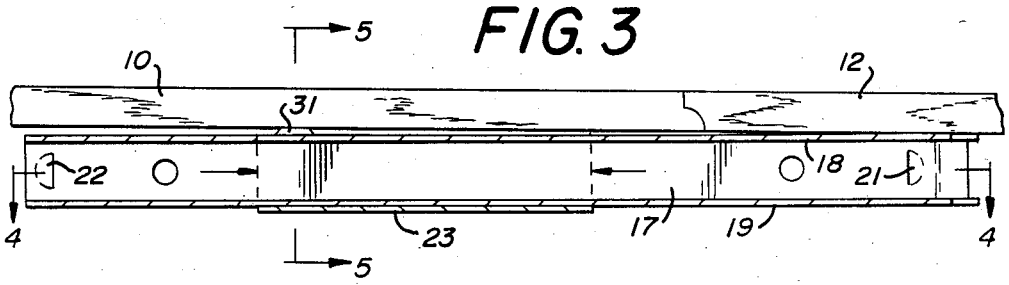
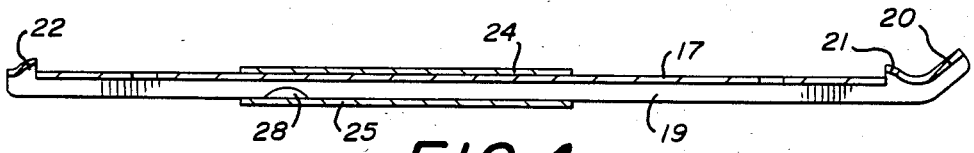
FIG. 4

TABLE LEAF SLIDE SUPPORT

This invention relates generally to drop leaf table leaf supports, and more particularly relates to a table leaf slide type support which is normally mounted under the main body of the table and is extendable to act as an underlying support when it is desired to raise a hinged drop leaf and to support the leaf in its raised position in which it acts as a horizontal planar extension of the main part of the table.

Table leaf slide supports are per se not new in the art, various forms of such devices being known and being fabricated from wooden or metal parts. The slide support according to the invention is made of metal and is less expensive to make because it eliminates some manufacturing steps necessary in some known forms of this type of a slide support. The entire support is made of only two pieces of metal which are die formed and interfitted with one another to provide the entire structure. Other known structures of this type require the use of more parts for forming a complete support. Accordingly, it is a primary object of the invention to provide a novel and simplified table leaf slide support fabricated of formed metal and requiring only two separate parts to constitute the entire structure.

Another object of the invention is to provide a novel slide support as aforesaid which comprises a channel shaped support member which is slidably disposed within a U-shaped bracket, both the bracket and the channel being lanced in a particular way which prevents jamming or wedging of the channel in the bracket and also functions to retain the channel within the bracket.

The foregoing and other objects of the invention will become clear from a reading of the following specification in conjunction with an examination of the appended drawings, wherein:

FIG. 1 is an isometric showing of a table and hinged table leaf with the novel support bracket shown in dashed form therebeneath in leaf supporting position;

FIG. 2 is an isometric showing of the slide support according to the invention;

FIG. 3 is a longitudinal vertical section through the slide support of FIG. 2 as would be seen when viewed along the line 3—3 of FIG. 2 and also shown in underlying position to a table top and supported drop leaf illustrating the organization of the slide support with the table elements;

FIG. 4 is a longitudinal horizontal section through the slide support of FIG. 2 as would be seen when viewed along the line 4—4 of FIG. 3; and FIG. 5 is a vertical cross-section view through the slide support as would be seen when viewed along the line 5—5 on FIG. 3.

In the several figures, like elements are denoted by like reference characters.

Turning now to the drawings, in FIG. 1 there is shown the central major portion of a table top designated generally as 10, and having secured thereto by hinges 11 and extending in plane horizontally therefrom a drop leaf 12. Disposed beneath the table top 10 and drop leaf 12 and shown generally in dashed form outline is the slide support shown generally as 13, the slide support 13 including a slidable leaf support 14 and a support bracket 15, all as best seen in FIGS. 2 through 5.

The slidable leaf support 14 is seen to be in the form of an elongated U-shaped channel 16 having a generally vertically disposed base wall 17 from the parallel extending top and bottom edges of which extend the elongated parallel top flange 18 and bottom flange 19. The U-shaped channel 16 is curved horizontally at the front end as shown at 20, and the base wall 17 is provided with a lancing 21 therethrough which extends outward away from the base wall 17 in the opposite direction from the top and bottom flanges 18 and 19, the lancing 21 being through the flat planar portion of the base wall 17 before the latter curves into the end 20. The opposite end of the base wall 17 is provided with a second lancing 22 proximate to the end thereto. The lancing 22 prevents the channel 16 from sliding longitudinally out of the support bracket 15 at the forward limit of travel, and the lancing 21 prevents jamming or wedging of the channel 16 when the channel is retracted into its non-use position.

The support bracket 15 is of generally U-shaped form having a bottom wall 23, a pair of upright parallel side walls 24 and 25 from the top edge of each of which extends a horizontally outwardly turned flange prallel to the bottom wall 23, the flanges being designated as 26 and 27. The side wall 25 is provided with a lancing 28 which extends inward into closely overlying position above the bottom flange 19 of the U-shaped channel 16, thus retaining the channel 16 seated within the support bracket 15 and preventing the channel from being cocked upward into rubbing engagement with the underside of the table top 10 when weight is placed upon the drop leaf 12. Four gussets 29 are formed at the junction of the side walls with the top flanges, two such gussets reinforcing the side wall 24 and top flange 26, with two other gussets providing the same reinforcing function for the side wall 25 and top flange 27.

Each of the top flanges 26 and 27 is provided with two spaced apart apertures for the placing of screws therethrough upward into the underside of the table top to secure the bracket to the table, the forwardly positioned apertures 30 being in plane with the flanges 26 and 27 while the rearwardly disposed apertures 31 are upwardly offset to provide a slight clearance between the under surface of the table 10 and the bracket top flanges 26 and 27, as best seen in FIG. 3. This insures that the support channel 16 when extended is inclined slightly upwardly to insure horizontal positioning of the drop leaf 12. Both the support bracket 15 and leaf support channel 16 are preferably formed of steel, and are progressively stamped and punched from strip steel to provide the assembled two part structure.

Having now described the invention in connection with a particularly illustrated embodiment thereof, variations and modifications of the invention may now naturally occur to those persons normally skilled in the art without departing from the essential scope and spirt of the invention, and accordingly it is intended to claim the same broadly as well as specifically as indicated by the appended claims.

What is claimed to be new and useful is:

1. A two piece table leaf slide support comprising in combination a U-shaped channel member and a support bracket slidably supporting said channel member, (a) said elongated U-shaped channel member having a vertical base wall, and a top flange and a bottom flange extending longitudinally orthogonally of said base wall, one end of said channel being curved with said top and bottom flanges remaining substantially in their respective planes, and means carried by said channel member effective to prevent said channel member from shifting endwise out of said support bracket, (b) said support bracket having a generally rectangular elongated bottom wall and a pair of parallel side walls extending upward from the long edges of said bottom wall and turning outward in a common plane in opposite directions at the upper edges of said side walls as a pair of top flanges, said top flanges including means by which said bracket may be secured to the underside of a table, and means carried by said support bracket effective to retain said channel member in the bracket below the level of said top flanges, said last named means comprising a lancing through one of said side walls which extends inward into closely overlying relationship to said bottom flange of said U-shaped channel member.

2. A table leaf slide support as described in claim 1 wherein said means carried by said channel member effective to prevent it from shifting endwise out of said support bracket is a lancing through the vertical base wall of said channel member proximate to the end of said channel remote from the said curved end.

3. A table leaf slide support as described in claim 2 further including means carried by said channel member effective to prevent jamming of said channel member in said support bracket when said channel member is retracted into its non-use position.

4. A table leaf slide support as described in claim 3 wherein said means carried by said channel member effective to prevent jamming of said channel member in said support bracket when said channel member is retracted into its non-use position is a lancing through the vertical base wall of said channel member proximate to the said curved end thereof.

* * * * *